United States Patent [19]

Fluck

[11] 4,394,899

[45] Jul. 26, 1983

[54] ARTICLE GROUPING APPARATUS

[75] Inventor: René Fluck, Schleitheim, Switzerland

[73] Assignee: SIG - Schweizerische Industrie-Gesellschaft, Neuhausen am Rheinfall, Switzerland

[21] Appl. No.: 213,724

[22] Filed: Dec. 5, 1980

[30] Foreign Application Priority Data

Dec. 13, 1979 [CH] Switzerland ..... 11066/79

[51] Int. Cl.[3] ..... B65G 29/00

[52] U.S. Cl. ..... 198/408; 198/425; 198/478; 198/487; 414/104; 414/107

[58] Field of Search ..... 198/408, 740, 425, 723, 198/462, 478, 487–488; 414/106–108, 104; 271/184–185, 177–178, 181, DIG. 10

[56] References Cited

U.S. PATENT DOCUMENTS

| | | | |
|---|---|---|---|
| 1,090,473 | 3/1914 | Gullberg et al. | 271/177 X |
| 1,974,931 | 9/1934 | Rose | 414/107 X |
| 1,985,897 | 1/1935 | Huntar | 198/478 |
| 2,842,253 | 7/1958 | Amerio et al. | 198/487 X |
| 4,130,480 | 12/1978 | Loewenthal . | |

FOREIGN PATENT DOCUMENTS

| | | |
|---|---|---|
| 532522 | 2/1973 | Switzerland . |
| 1266589 | 3/1972 | United Kingdom . |
| 1330300 | 9/1973 | United Kingdom . |
| 1336602 | 11/1973 | United Kingdom . |
| 1457611 | 12/1976 | United Kingdom . |
| 359158 | 10/1981 | United Kingdom . |

*Primary Examiner*—Joseph E. Valenza
*Assistant Examiner*—Paul A. Sobel
*Attorney, Agent, or Firm*—Spencer & Kaye

[57] ABSTRACT

An apparatus for forming groups of upright-oriented, stacked articles includes a supply conveyor for advancing the articles in a flat-lying, spaced relationship, a conveyor wheel and transfer pushers pivotally secured to the conveyor wheel in a circular array. The transfer pushers extend outwardly from the wheel and are arranged for consecutively lifting off flat-lying articles from the supply conveyor and for conveying the articles in a curvilinear path from an upstream end to a downstream end thereof. A guiding mechanism imparts a pivotal motion to the transfer pushers during their travel along the curvilinear path. There are further provided a gathering channel adjoining the downstream end of the curvilinear path for receiving articles from the transfer pushers in an upright orientation and a gathering pusher travelling in a closed orbital path for periodically engaging and advancing a group of upright-oriented, face-to-face arranged articles on the gathering channel from the downstream end of the curvilinear path.

8 Claims, 10 Drawing Figures

Fig. 1
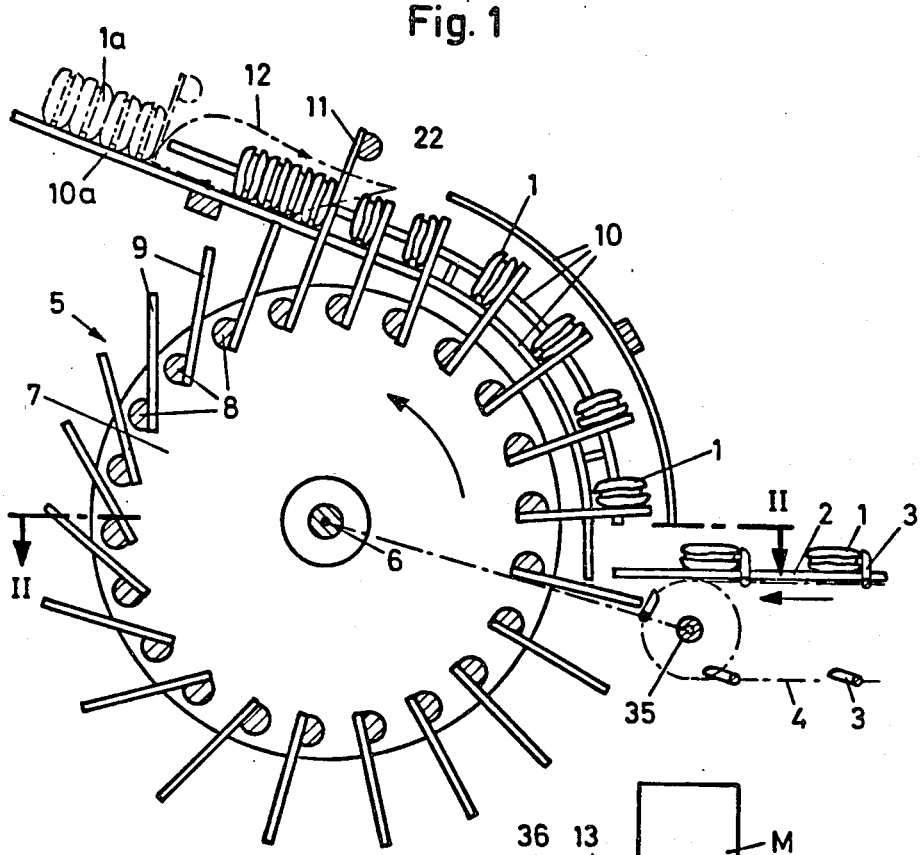
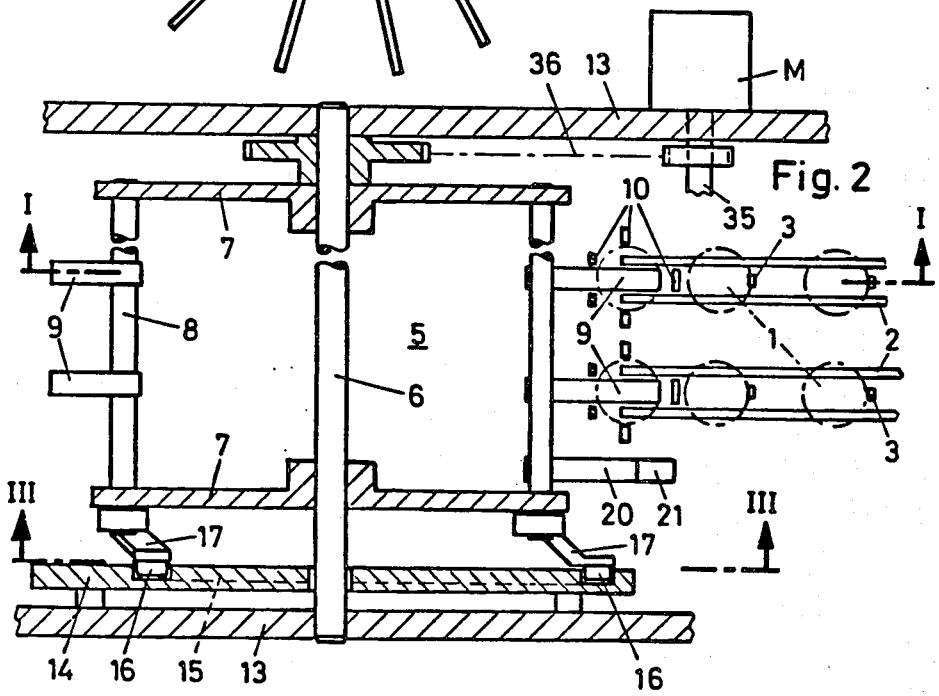

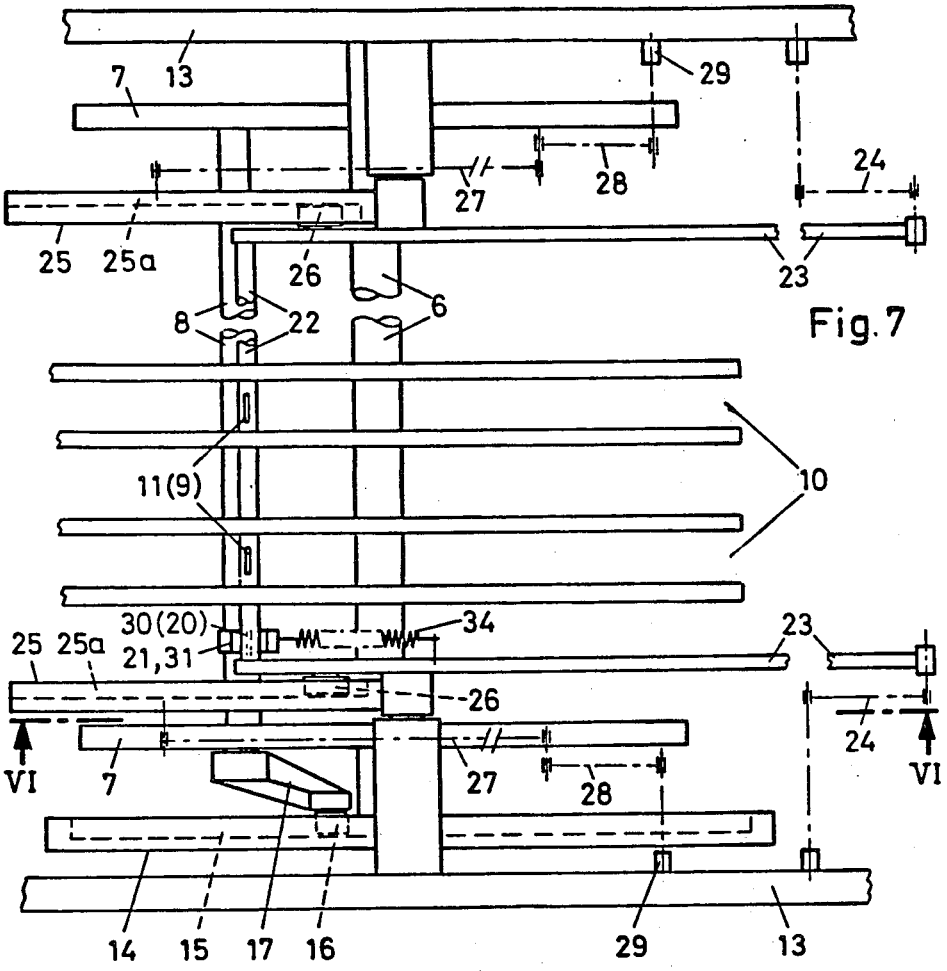
Fig. 7
Fig. 10
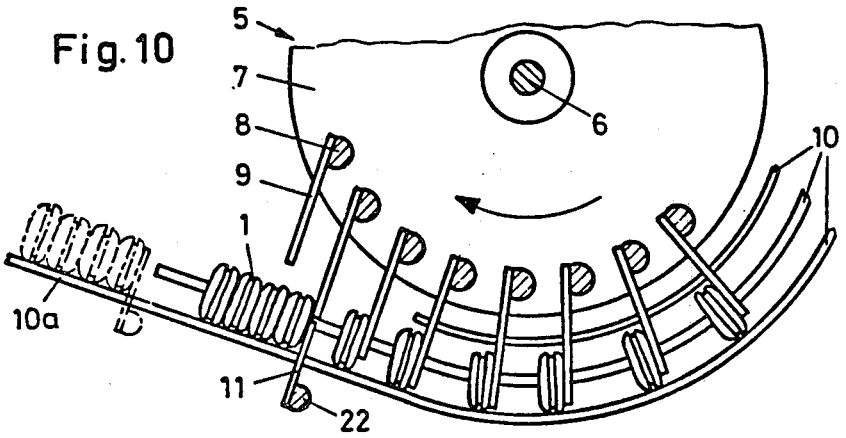

ARTICLE GROUPING APPARATUS

BACKGROUND OF THE INVENTION

This invention relates to an apparatus which forms groups of upright-oriented (that is, edgewise standing), face-to-face arranged flat articles which are introduced into the apparatus flat-lying and individually spaced and which are thereafter conveyed between transfer pushers of a circulating conveyor. The transfer pushers advance the articles in an edgewise orientation to a collecting channel where the articles are gathered in groups. The articles are further advanced in groups by a gathering pusher which takes over conveyance of the articles from the transfer pushers.

Article handling apparatuses of the above-outlined type are known; their structure is often adapted to the particular properties of the articles to be grouped. Thus, for example, in Swiss Pat. No. 532,522 there is disclosed an apparatus in which the articles to be moved are accumulated in a flat-lying position on a supply belt and then the articles are transferred to a rotary conveyor wheel which, in turn, transfers them in an upright position to an output conveyor. Apparatuses of this type are adapted to convey only relatively non-delicate items because they are submitted to significant pressure and frictional effects.

Further, U.S. Pat. No. 4,130,480 discloses an apparatus in which relatively flat packages are, by means of endless chains having perpendicularly outwardly projecting pushers, advanced in a flat-lying condition to a stacking wheel which, in turn, advances the packages in an edgewise orientation and in a stacked condition to a collecting channel. In this apparatus too, the packages are exposed to friction effects and compressions during their conveyance which, however, have no particular significance there, since the articles are already packed and therefore protected by the wrapper.

SUMMARY OF THE INVENTION

It is an object of the invention to provide an improved apparatus of the above-outlined type wherein the article grouping is effected by a particularly gentle handling of the articles, so that the surface of the articles is exposed to as little pressure and friction effect as possible.

The apparatus according to the invention is designed particularly for processing "layered" sweets in which a cream filling is sandwiched between two superposed cookies. At the time the cookies enter the machine, the filling has often not yet solidified and consequently, the articles are highly pressure sensitive.

The above object and others to become apparent as the specification progresses, are accomplished by the invention, according to which, briefly stated, the apparatus has a rotating conveyor wheel carrying a plurality of pivotally arranged transfer pushers having outwardly oriented free ends. The apparatus further has a guide mechanism for causing a predetermined pivotal motion of the transfer pushers as the conveyor wheel rotates. The apparatus also has an orbiting gathering pusher which periodically extends into the traveling path of the articles for assuming conveyance of article groups as they leave the operational zone of the conveyor wheel and for advancing the article groups into a gathering channel.

Expediently, the transfer pushers of the conveying wheel project into a guide track in which the articles slide while engaging the guide track with their narrow sides and wherein the guide track changes from an arcuate (circular) inlet zone which is coaxial to the conveyor wheel, into an obliquely and upwardly oriented, tangentially extending outlet zone into which extends the particularly controlled gathering pusher.

Articles handled by an apparatus structured according to the invention are exposed to minimal stresses, so that a high grouping output of up to one thousand articles per minute and per row can be achieved. In addition, the apparatus according to the invention has a simple construction and requires only minimum maintenance, particularly since it is void of any wear-exposed conveyor chains.

BRIEF DESCRIPTION OF THE DRAWING

FIG. 1 is a sectional view of a preferred embodiment of the invention taken along line I—I of FIG. 2.

FIG. 2 is a longitudinal sectional view taken along line II—II of FIG. 1.

FIG. 7 is a top plan view in the direction of the arrow VII shown in FIG. 6 (some of the components being omitted).

FIG. 10 is a partially sectional side elevational view of a variant of the structure shown in FIG. 1.

DESCRIPTION OF THE PREFERRED EMBODIMENTS

Figure 3:
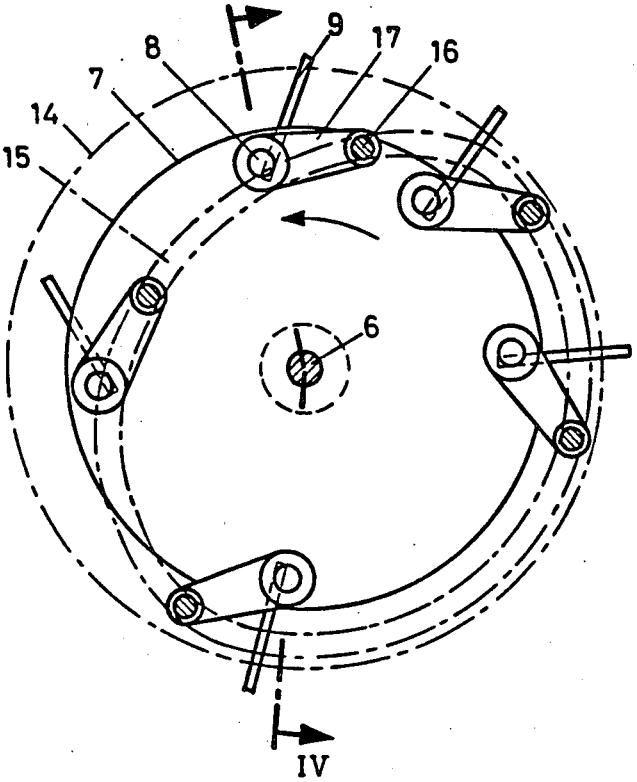
FIG. 3 is a sectional view taken along line III—III of FIG. 2.
Figure 4:
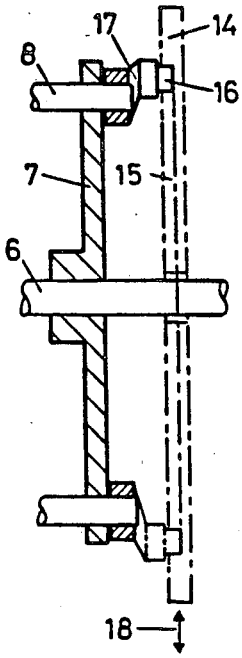
FIG. 4 is a sectional view taken along line IV—IV of FIG. 3.

Turning now to FIGS. 1 and 2, the apparatus shown therein is arranged at the output end of a machine (not shown) which manufactures articles 1, each, for example, essentially consisting of two superposed cookies with a cream filling (for example, a chocolate cream filling) sandwiched therebetween.

The articles 1 are advanced from the output of the cookie making machine on several parallel conveyor tracks 2, of which only two are shown in FIG. 2. On the tracks 2 the flat-lying articles 1 are advanced in a uniformly spaced relationship by means of conveyor pushers 3 which are mounted on an endless chain 4 and which, at the end of the respective conveyor track 2 are, in a known manner, folded flat into an inoperative position, as shown in FIG. 1. At the downstream end of the conveyor tracks 2 there is arranged a conveyor wheel 5 which is rotated counterclockwise about the axis of a driven shaft 6 as indicated by the arcuate arrow in FIG. 1. The conveyor wheel 5 has two parallel-spaced discs 7 which are rigidly affixed to the shaft 6 and are perpendicular thereto. A plurality of shafts 8 are, in a circumferential array, held in the discs 7, so that the discs 7 and the shafts 8 together form a squirrel-cage like structure. Each shaft 8 is rotatable about its own longitudinal axis and carries a plurality of transfer pushers 9, the number of which on each shaft equals the number of conveyor tracks 2. As may be particularly well observed in FIG. 1, as the conveyor wheel 5 rotates, the transfer pushers 9 extend into the clearance defined between the respective two rails forming each conveyor track 2 and take over the conveyance of individual articles 1 which were advanced to the conveyor wheel 5 on the conveyor track 2.

Each transfer pusher 9, after moving away upwardly (as viewed in FIG. 1) from the conveyor track 2 and lifting, at the same time, a respective article 1, continues the conveyance of the article 1 on parallel-spaced bars of a guide track 10 which, at the inlet zone, is of arcuate course coaxial with the shaft 6 and forms, at the outlet zone, a gathering channel 10*a* which extends obliquely upwardly tangentially to the arcuate inlet portion. Thus, as the conveyor wheel 5 rotates, the transfer pushers 9 move out of the guide track 10. A gathering pusher 11 projects periodically into the tangential zone of the guide track 10 after a predetermined number of transfer pushers 9 with articles 1 has passed. The free end of the gathering pusher 11 moves along a curvilinear path indicated by the closed broken line 12 in FIG. 1, while pushing a group of articles 1 to a transfer location, as shown in phantom lines at 1*a*. The structure and control of the gathering pusher 11 will be discussed in greater detail in conjunction with FIGS. 6 and 7.

During their orbital motion, the transfer pushers 9 of the conveyor wheel 5 are controlled in such a manner that in the zone of the guide track 10 they always extend approximately perpendicularly thereto. This automatically has the consequence that the articles 1 advanced by the transfer pushers 9 in the outlet zone 10*a* have a smaller distance from one another than in the inlet zone of the guide track 10. This is of significance to ensure that the articles, during the group formation, follow one another as closely as possible and are not capable of tipping backward but rather, they are in a face-to-face engagement with one another.

Figure 5:
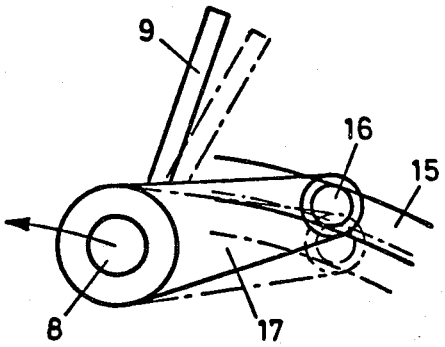
FIG. 5 is a side elevational view of a detail of the preferred embodiment shown in FIG. 3.

The control of the transfer pushers 9 and their respective shaft 8 during rotation of the conveyor wheel 5 is illustrated in FIGS. 2 through 5. The drive shaft 6 of the conveyor wheel 5 is supported in stationary frame plates 13. On one of the frame plates 13 a contoured control disc 14 can be rotarily adjusted and immobilized in any adjusted position. The control disc 14 comprises a closed cam track 15 (FIG. 3) into which project follower rollers 16 of respective crank arms 17 which, in turn, are fixedly connected with the shafts 8. By virtue of an appropriate arcuate course of the cam track 15, the pushers 8 may execute the desired relative pivotal motion with respect to the discs 7 of the conveyor wheel 5. An even more accurate setting of the position of the transfer pushers 9 in the outlet zone 10*a* of the guide track 10 can be achieved by providing that the control disc 14 is slightly displaceable linearly with respect to the frame plate 13 as indicated by the double-headed arrow 18 in FIG. 4. The additional pivotal motion of a respective transfer pusher 9 by means of such a shift of the control disc 14 is illustrated in FIG. 5; such a displacement additionally results in a further decrease of the distance between the adjacent transfer pushers 9. The displaceability of the control disc 14 with respect to the frame plate 13 may be effected in a known manner, for example, by sliding guides or the like.

As seen in FIG. 2, on each shaft 8 of the conveyor wheel 5 adjacent the respective transfer pusher 9 there is laterally arranged an additional bar 20 which at its free end carries a guide fork 21. The bar 20 lies in the same plane as the associated transfer pusher 9.

FIGS. 6–9 illustrate the drive and control (guidance) of the gathering pusher 11, a separate one being associated with each guide track 10. All gathering pushers 11 are mounted on a transverse bar 22 which is rotatably supported in two guide bars 23. Each guide bar 23 is articulated to a driving lever 24 which in turn is pivotally supported in a stationary bearing provided in the frame plate 13. The driving levers 24 execute periodically an oscillating motion through an angle $\alpha$. On the frame plate 13 there are further articulated two angled guide levers 25 which have a U-shaped cross section to form guide grooves 25*a* for two guide rollers 26 which are supported rotatably on the guide bars 23. The guide levers 25 are further pivotally mounted by means of two bars 27 and 28 on a bearing 29 secured to the frame plate 13. The bars 28 thus execute periodically an oscillating motion through an angle $\beta$. It is noted that in FIG. 7 the above-described bars are shown only by their respective longitudinal axis. The above-described linkage assembly provides that the free end of the gathering pushers 11 describe the closed curvilinear path 12 shown in FIGS. 1 and 6 for the purpose of advancing the groups of articles 1 on the outlet portion 10*a* of the guide track 10.

In view of the fact that for a satisfactory operation of the apparatus an extremely accurate cooperation of the transfer pushers 9 with the gathering pushers 11 is required, these components are associated with a particular synchronizing assembly. For this purpose, the bars 20 are mounted on the shafts 8 such that they extend in the same plane as the respective transfer pushers 9. On the transverse bar 22 there is secured a bar 30 which lies in the same plane as the gathering pushers 11 and which carries, at its free end, a cylindrical head 31, the diameter of which is so dimensioned that upon convergence of a row of transverse pushers 9 with a row of gathering pushers 11, it can project practically without clearance into the fork 21. The bar 30 further has an abutment 32 which may engage a projection 33 provided on the guide bar 23. Further, a biased tension spring 34 is, at its two ends, attached to the bars 23 and 30 to ensure that the bar 30 and together therewith, the gathering pushers 11 are at all times pulled towards a position shown in FIG. 9. The components 20, 21 and 30, 31 thus ensure that the cooperation between the transfer pushers 9 on the one hand and the gathering pushers 11 on the other hand are synchronized in an operationally reliable manner.

FIG. 10 illustrates a variant of the apparatus shown in FIG. 1. The difference between the two structures resides in that the embodiment shown in FIG. 10 has its guide track 10 and thus the conveying portion of the conveyor wheel 5 on the lower side thereof. The transfer of the article groups by means of the gathering pushers 11 occurs in the same manner as in the previously described embodiment with the difference that they engage into the guide track 10 from below.

It is further feasible to provide that a plurality of superposed articles 1 is advanced from the guide tracks 2 to pushers 9, for example, two cookies without cream filling are advanced. Thus, with the apparatus according to the invention a larger group may be formed of several smaller article groups.

Figure 6:
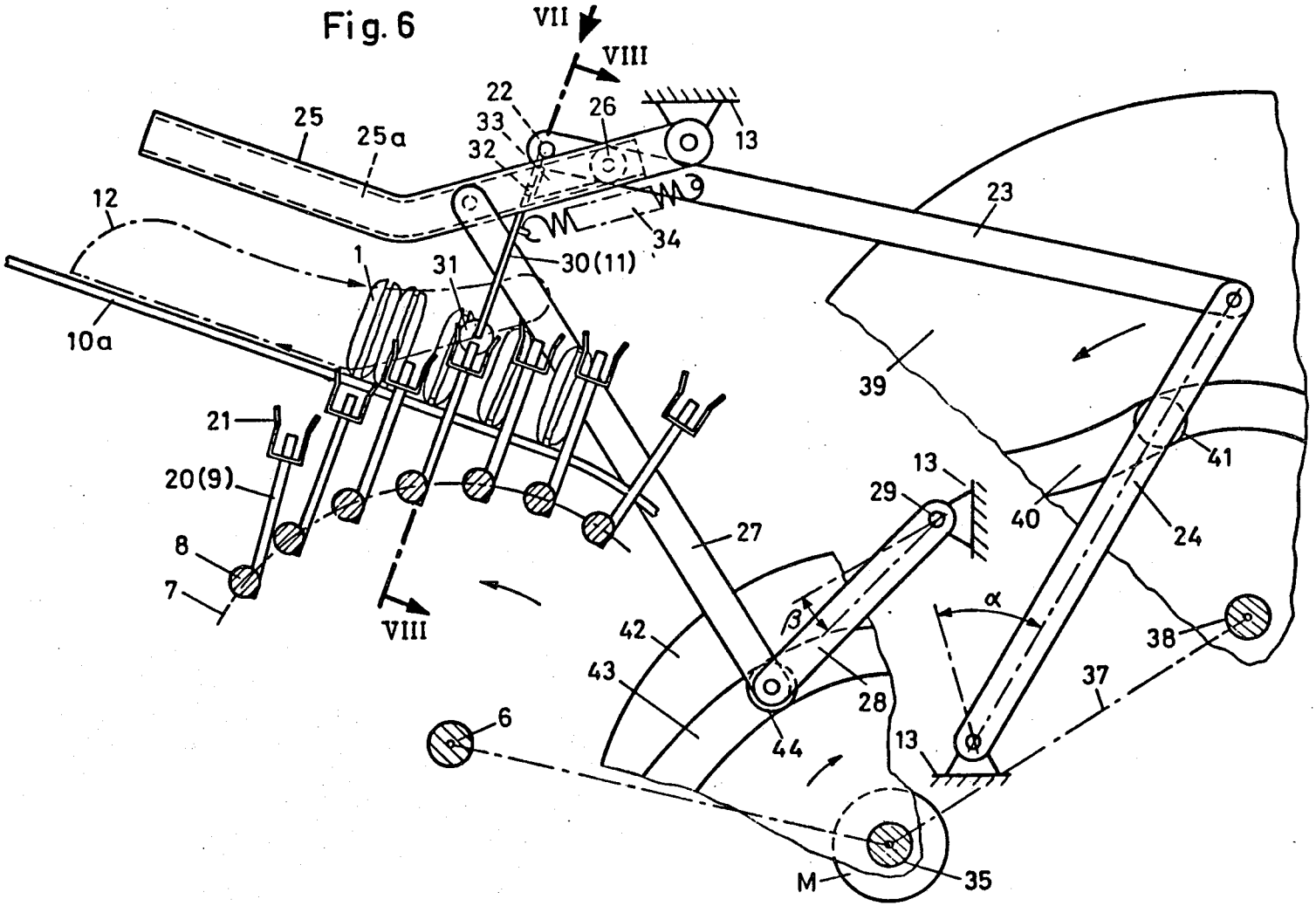
FIG. 6 is a sectional view taken along line VI—VI of FIG. 7.
Figure 8:
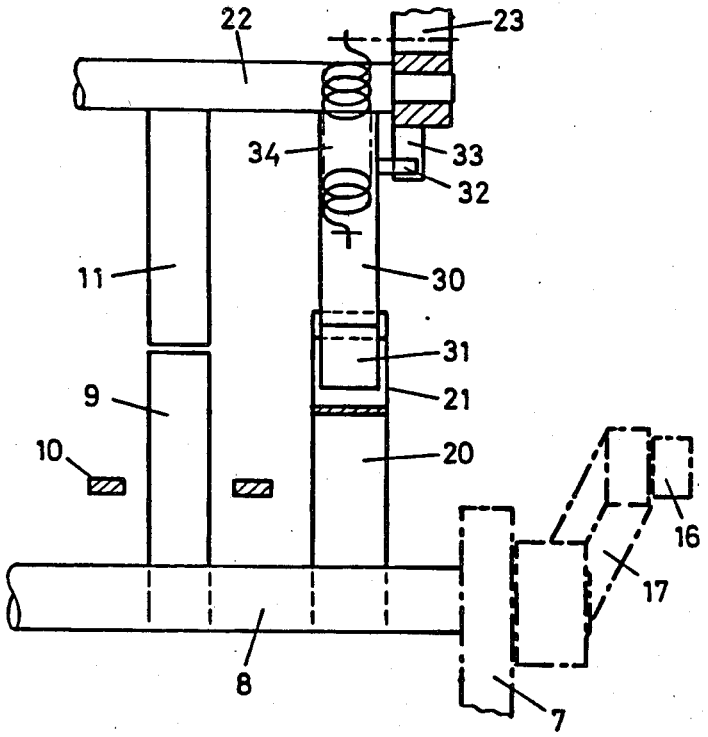
FIG. 8 is an enlarged sectional view taken along line VIII—VIII of FIG. 6.
Figure 9:
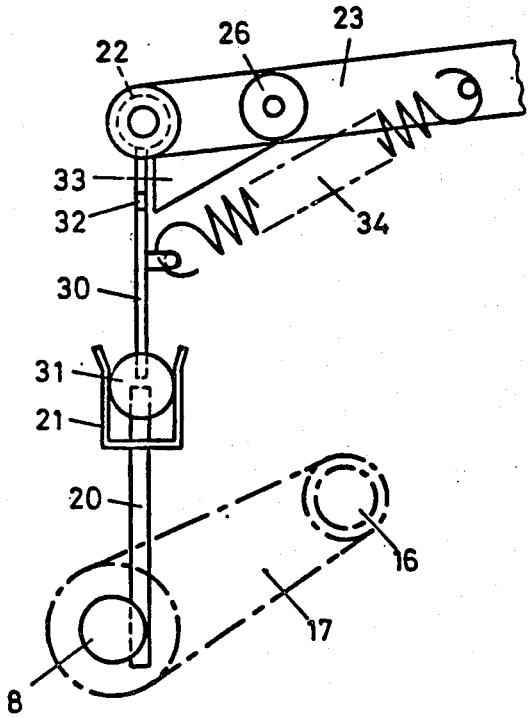
FIG. 9 is a side elevational view of the structure shown in FIG. 8.

The mechanism for driving the shaft 6 of the conveyor wheels and the mechanism for oscillating the lever 24 are shown basically in FIGS. 1 and 6. The endless chain 4 is driven by motor M by means of the shaft 35. Driving means for providing reduction of the number of revolution in the ratio of 1:11 are only shown by broken lines 36 in FIG. 1 for the means per se being well known in the art. The reduced speed is thereby transmitted on shaft 6 of the conveyor wheel 5.

Turning now to FIG. 6, the shaft 35 of the motor M also drives, by means of a symbolically illustrated connection 37, the shaft 38 which, in turn, drives a cam disc 39 having a groove 40 into which a roller 41 rotating idle on lever 24 extends for providing a reciprocating movement when cam disc 39 rotates. A further cam disc 42 is mounted for free wheeling on shaft 35 and is driven by known, but not shown means. The cam disc 42 has a cam groove 43 guiding a follower roller 44 mounted on the hinged fixation point of levers 27, 28. This arrangement results in a reciprocating movement of lever 27.

It will be understood that the above description of the present invention is susceptible to various modifications, changes and adaptations, and the same are intended to be comprehended within the meaning and range of equivalents of the appended claims.

What is claimed is:

1. In an apparatus for forming groups of upright-oriented, stacked articles, including a supply conveyor for advancing the articles in a flat-lying, spaced relationship; the improvement comprising (a) a conveyor wheel supported for rotation about a wheel axis and situated adjacent said supply conveyor;

(b) means for rotating said conveyor wheel;

(c) a plurality of transfer pushers pivotally secured to said conveyor wheel in a circular array about said wheel axis; said transfer pushers extending, from their pivotal attachment, in a direction oriented away from said wheel axis; said transfer pushers being arranged for consecutively lifting off flat-lying articles from said supply conveyor and for conveying the articles in a curvilinear path from an upstream end to a downstream end thereof;

(d) guiding means for imparting a pivotal motion to said transfer pushers during their travel along said curvilinear paht; said guiding means including (1) a plurality of pivot shafts rotatably mounted in said conveyor wheel in a circular array about said wheel axis and in an orientation parallel to said wheel axis; said transfer pushers being mounted to a respective said pivot shaft;

(2) a crank arm attached to each pivot shaft;

(3) follower means carried on each crank arm; and (4) a control disc supported adjacent said conveyor wheel; said control disc including a closed cam track into which project said follower means of said crank arms; the course of said closed cam track being such that upon rotation of said conveyor wheel the ends of said transfer pushers remote from their pivotal attachment are closer to one another in the zone of said downstream end than in the zone of said upstream end of said curvilinear path;

(e) a guide track having a first, circularly acruate portion coinciding with said curvilinear path; said first portion having a clearance through which said transfer pushers project for advancing articles by sliding the articles in an upright position along said first portion of said guide track; said guide track having a second portion adjoining said first portion and extending tangentially thereto in an upwardly sloping orientation; said second portion of said guide track constituting a gathering channel adjoining the downstream end of said curvilinear path for receiving articles from said transfer pushers in an upright orientation;

(f) a gathering mechanism including a gathering pusher and moving means for displacing said gathering pusher in a closed orbital path for periodically engaging and advancing a group of upright-oriented, face-to-face arranged articles along said gathering channel from said downstream end; and (g) synchronizing means connected to said transfer pushers and said gathering pusher for mechanically coupling selected transfer pushers with said gathering pusher by interfitting engagement of said synchronizing means for synchronizing the motion of said gathering pusher with each said transfer pusher.

2. An apparatus as defined in claim 1, wherein said moving means of said gathering mechanism comprises (a) a pivotally supported guide lever including a guide groove;

(b) a guide bar including a follower means projecting into said guide groove;

(c) a transverse bar attached to said guide bar and extending transversely thereto; said transverse bar carrying said gathering pusher; and (d) drive means for oscillating said guide bar for moving said gathering pusher in said closed orbital path.

3. In an apparatus for forming groups of upright-oriented, stacked articles, including a supply conveyor for advancing the articles in a flat-lying, spaced relationship; the improvement comprising (a) a conveyor wheel supported for rotation about a wheel axis and situated adjacent said supply conveyor;

(b) means for rotating said conveyor wheel;

(c) a plurality of transfer pushers pivotally secured to said conveyor wheel in a circular array about said wheel axis; said transfer pushers extending, from their pivotal attachment, in a direction oriented away from said wheel axis; said transfer pushers being arranged for consecutively lifting off flat-lying articles from said supply conveyor and for conveying the articles in a curvilinear path from an upstream end to a downstream end thereof;

(d) guiding means for imparting a pivotal motion to said transfer pushers during their travel along said curvilinear path;

(e) a gathering channel adjoining the downstream end of said curvilinear path for receiving articles from said transfer pushers in an upright orientation; and (f) a gathering mechanism including a gathering pusher and moving means for displacing said gathering pusher in a closed orbital path for periodically engaging and advancing a group of upright-oriented, face-to-face arranged articles on said gathering channel from said downstream end; said moving means including (1) a pivotally supported guide lever including a guide groove;

(2) a guide bar including a follower means projecting into said guide groove;

(3) a transverse bar attached to said guide bar and extending transversely thereto; said transverse bar carrying said gathering pusher; and (4) drive means for oscillating said guide bar for moving said gathering pusher in said closed orbital path;

(g) a plurality of pivot shafts rotatably mounted in said conveyor wheel in a circular array about said wheel axis and in an orientation parallel to said wheel axis; said transfer pushers being mounted to a respective said pivot shaft;

(h) a crank arm attached to each pivot shaft;

(i) follower means carried on each crank arm;

(j) a control disc supported adjacent said conveyor wheel; said control disc including a closed cam track into which project said follower means of said crank arms; the course of said closed cam track being such that upon rotation of said conveyor wheel the ends of said transfer pushers remote from their pivotal attachment are closer to one another in the zone of said downstream end than in the zone of said upstream end of said curvilinear path; the pivot shafts, the crank arms, the follower means and the control disc forming part of said guiding means for imparting a pivotal motion to said transfer pushers;

(k) a plurality of first synchronizing members mounted on a respective said pivot shaft; and (l) a second synchronizing member mounted on said transverse bar and being arranged for a form-fitting interengagement with a respective said first synchronizing member in the zone of said downstream end of said curvilinear path whereby motions of said gathering pusher and a respective said transfer pusher are synchronized.

4. An apparatus as defined in claim 3, further comprising a guide track having a first, circularly arcuate portion coinciding with said curvilinear path; said first portion having a clearance through which said transfer pushers project for advancing articles by sliding the articles in an upright position along said first portion of said guide track; said guide track having a second portion adjoining said first portion and extending tangentially thereto in an upwardly sloping orientation; said second portion of said guide track constituting said gathering channel.

5. An apparatus as defined in claim 4 or 1, wherein said guide track is formed of a pair of parallel spaced rails and wherein said clearance is defined by the spacing between the rails.

6. An apparatus as defined in claim 4 or 1, wherein said conveyor wheel has a generally vertical plane of rotation; and further wherein said first portion of said guide track is situated above said conveyor wheel.

7. An apparatus as defined in claim 3, wherein said guiding means for imparting a pivotal motion to said transfer pushers comprises (a) a plurality of pivot shafts rotatably mounted in said conveyor wheel in a circular array about said wheel axis and in an orientation parallel to said wheel axis; said transfer pushers being mounted to a respective said pivot shaft;

(b) a crank arm attached to each pivot shaft;

(c) follower means carried on each crank arm; and (d) a control disc supported adjacent said conveyor wheel; said control disc including a closed cam track into which project said follower means of said crank arms; the course of said closed cam track being such that upon rotation of said conveyor wheel the ends of said transfer pushers remote from their pivotal attachment are closer to one another in the zone of said downstream end than in the zone of said upstream end of said curvilinear path.

8. An apparatus as defined in claim 7 or 1, further comprising a machine frame; said control disc being supported in said machine frame and being adjustable into and lockable in desired positions.

* * * * *